US005816451A

United States Patent [19]

Renault

[11] Patent Number: 5,816,451

[45] Date of Patent: Oct. 6, 1998

[54] FLEXIBLE PACKAGING TUBE

[75] Inventor: Philippe Renault, Chaville, France

[73] Assignee: L'Oreal, Paris, France

[21] Appl. No.: 636,689

[22] Filed: Apr. 23, 1996

[30] Foreign Application Priority Data

Apr. 24, 1995 [FR] France ..... 95 04870
Mar. 28, 1996 [FR] France ..... 96 03882

[51] Int. Cl.[6] ..... B65D 37/00
[52] U.S. Cl. ..... 222/215
[58] Field of Search ..... 222/206, 212, 222/215, 107, 386; 264/454

[56] References Cited

U.S. PATENT DOCUMENTS 2,297,994 10/1942 Vellinga ..... 222/215
4,776,494 10/1988 Holoubek ..... 222/212
4,984,712 1/1991 Jouillat ..... 222/107
5,213,235 5/1993 Miranda .
5,299,689 4/1994 Ledewitz ..... 222/107
5,301,840 4/1994 Sun ..... 222/215

FOREIGN PATENT DOCUMENTS 0 385 942 9/1990 European Pat. Off. .
0 508 168 10/1992 European Pat. Off. .
2 015 438 4/1970 France .
1050837 12/1966 United Kingdom ..... 222/386

*Primary Examiner*—Philippe Derakshani
*Attorney, Agent, or Firm*—Oliff & Berridge, PLC

[57] ABSTRACT

A flexible packaging tube comprising a malleable elongate tubular body obtained by blow-molding, having a closed bottom without folding or crimping due to heat-sealing, and a cylindrical outlet portion formed by a shoulder zone at the top of said tubular body. When the tubular body is seen in front elevation, its apparent width increases downwardly from the shoulder zone where the tubular body connects with the top cylindrical outlet portion to the bottom end constituting the bottom of the tubular body.

19 Claims, 3 Drawing Sheets

FLEXIBLE PACKAGING TUBE

The present invention relates to a flexible packaging tube suitable for packaging and dispensing various substances that are liquid, or in the form of pastes or creams.

BACKGROUND OF THE INVENTION

Flexible packaging tubes have been used for a very long time in the food industry, for personal hygiene products such as toothpaste and shampoos, and in cosmetics. Such a tube comprises a package constituted by a malleable, elongate tubular body whose bottom is closed, generally by folding and/or heat sealing, with the packaged substance responding to finger pressure applied to the wall of the tubular body by being expelled through a small diameter cylindrical outlet portion formed on a generally frustoconical shoulder zone which is located at the top end of the tubular body, and which is circular or oval in section, in practice.

The cylindrical outlet portion generally includes an outside thread for receiving a screw cap having an inside wall provided with a complementary thread or an inside skirt provided with such a thread.

The malleable tubular body is usually constituted by a single layer material, with said material being a thermoplastic polymer.

When the tubular body is made of a laminated material based on thermoplastic polymers, the bottom of the tubular body is closed, generally after it has been filled with substance, by crimping and heat-sealing.

This operation gives rise to a rigid ribbed zone being formed on the bottom portion of the tubular body, which zone is substantially in the form of a flattened parallelepiped having sharp edges that constitute the bottom end of the tubular body.

Seen in front elevation, the tubular body is substantially trapezium-shaped over at least a portion of its height going up from its bottom portion due to the flattening thereof during closure.

One example of such a packaging tube whose tubular body is closed by crimping and heat-sealing is described with reference to FIG. 5 et seq. of U.S. Pat. No. 5,301,840.

In practice, the presence of the rigid zone caused by heat-sealing is a source of drawbacks, insofar as making contact therewith, particularly its corners, can give rise to a user being pricked or scratched, and can also damage objects that come into contact therewith, in particular by scratching them, as can happen in baggage or in a handbag.

In addition, because the heat-sealed zone is rigid, the tube is often not completely emptied by being squeezed.

It is also possible for the seal to break accidentally, in which case the substance leaks out.

Finally, the tube cannot be filled completely since it is not possible to perform heat-sealing through the substance. As a result there is an empty space inside the tube, and when the tube is transparent that is unacceptable at the point of sale.

Proposals have also been made to form a flexible packaging tube that is closed at its bottom portion without requiring heat-sealing.

An embodiment of such a flexible tube whose tubular body is made with a bottom that is closed by blow-molding a multilayer laminated material is described with reference to FIGS. 1 to 4 of above-mentioned U.S. Pat. No. 5,301,840. The tube is filled through its top outlet portion, after which a dispensing nozzle fitted with closure means is put into place thereon.

In front view, the resulting tubular body has a "test-tube" outline with a rounded bottom and sides that are parallel to the longitudinal axis of the tube.

Unfortunately, it has been observed that, in practice, consumers are used to the appearance of conventional tubes and are very reticent in accepting a shape of the kind that results from the teaching of U.S. Pat. No. 5,301,840 as given with reference to FIGS. 1 to 4, and that this applies even though there is no rigid heat-sealing zone in the bottom portion of the tubular body.

OBJECTS AND SUMMARY OF THE INVENTION

The present invention seeks to provide a packaging tube whose tubular body obtained by blow-molding does not include a rigid zone in its bottom portion and which not only offers the advantage of presenting an appearance that is close to that of a traditional tube that does indeed have a rigid zone in its bottom portion, but which also serves to package a quantity of substance that is greater than the quantity packaged by a tube obtained without heat-sealing as described with reference to FIGS. 1 to 4 of above-mentioned U.S. Pat. No. 5,301,840.

In the tube of the present invention, when the tubular body is seen in front elevation, its apparent width increases downwardly from the shoulder zone where the tubular body connects with the top cylindrical outlet portion to the bottom end constituting the bottom of the tubular body.

In other words, in front elevation, the apparent width of the tubular body in its top portion, i.e. its diameter for a body that is circular in section or its largest dimension for a body that is elliptical or oval, is less than its width at the bottom of the tube.

The generator lines of the tubular body may be straight or curved such that seen in front elevation the tubular body may appear to be straight-sided in shape or curved-sided in shape.

Thus, the tube body of the present invention, when seen in front elevation, is substantially trapezium-shaped over at least a fraction of its height going up from its bottom, being close to the traditional shape of a heat-sealed tube body. The bottom appears to be straight and perpendicular to the longitudinal axis of the tube, but it does not have any sharp edges.

Because of the way its base is enlarged, for a given height of tubular body and for the same section at the top portion thereof, the tube of the present invention can contain a quantity of packaged substance that is greater than the quantity which can be contained by the above-mentioned known tubes that also do not have a heat-sealed bottom.

Because the tube is filled through its top portion, the tube can contain a quantity of substance that is greater than the quantity contained in a known tube filled through its bottom portion and closed by folding or by heat-sealing.

When seen in side elevation, the tubular body of the tube of the invention is substantially V-shaped with a rounded vertex situated at the base of said body. The tubular body is filled up its entire height.

Depending on the nature of the substance that is packaged and that is to be dispensed, the cylindrical outlet portion which is formed integrally with the remainder of the tubular body during the blow-molding step can receive a dispensing endpiece, such as a small-orifice capsule which may be installed by screw engagement or a capsule with a tapering nozzle that may be fixed by screw engagement or by snap-fastening.

Advantageously, the cross-section of the tube in its top portion is circular, elliptical, or oval, and the width of the tube at its bottom end is substantially equal to half the perimeter of said cross-section.

In a particular embodiment of the invention, the outside dimensions of said cylindrical outlet portion correspond substantially to the outside dimensions of said tubular body, leaving allowance for the thickness of the wall of a closure capsule to be connected on said cylindrical outlet portion, said closure capsule being provided with an eccentric outlet orifice for the substance.

In a preferred embodiment of the invention, the tube is oval in cross-section at its bottom end so that the two opposite main faces of the tube are convex towards the outside going from the top of the tube all the way to its bottom end. The convex shape at all points on the main faces of the tube facilitates applying decoration thereto. In this embodiment, the tube is preferably oval in cross-section in its shoulder zone, with the major dimension of the tube in the shoulder zone extending parallel to the major dimension of the tube at its bottom end.

Advantageously, the inside diameter of the cylindrical outlet portion is greater than or equal to 5 mm so as to make filling easy. A tapering nozzle is then advantageously fixed on said cylindrical outlet portion so as to reduce the diameter of the outlet orifice for the substance.

BRIEF DESCRIPTION OF THE DRAWINGS

In order to make the invention better understood, there follows a description of non-limiting embodiments given with reference to the accompanying drawings, in which.

MORE DETAILED DESCRIPTION

Reference is made initially to FIGS. 1 to 4.

Figure 4:
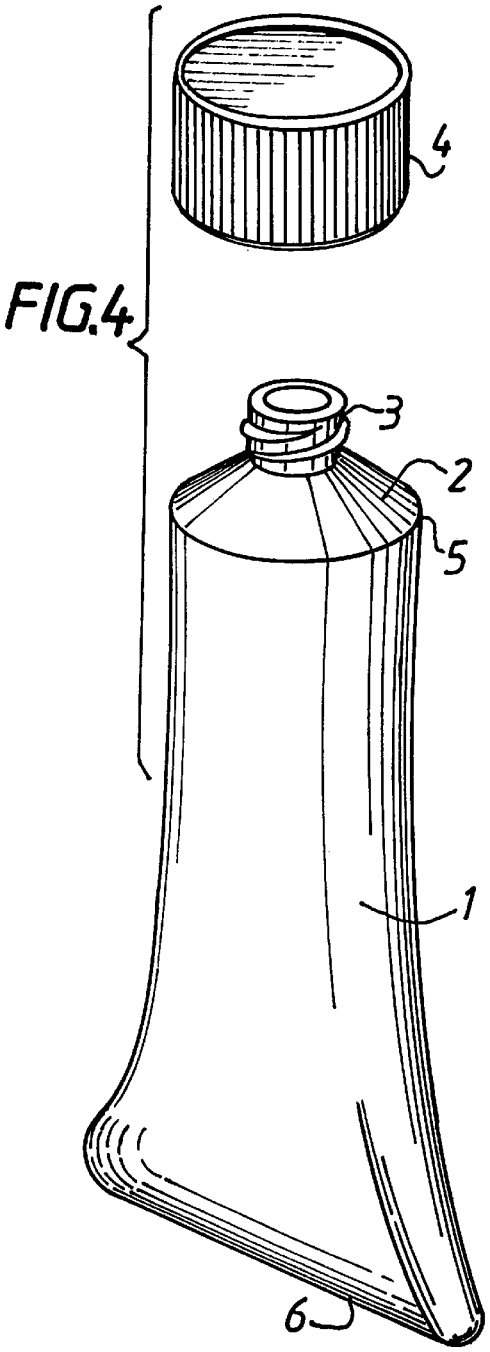
FIG. 4 is a perspective view of the packaging tube of FIGS. 1 and 2 in an open position.

As can be seen in FIG. 4, the packaging tube comprises a tubular body 1 which is provided with a frustoconical top shoulder zone 2 having a small diameter cylindrical outlet portion 3 which is provided, in the example shown, with an outside thread enabling a closure cap 4 that includes an inside thread (not visible in the drawing) to be received directly. Where appropriate, the outside thread of the cylindrical outlet portion 3 may serve to receive a dispensing endpiece, such as a capsule provided with a dispensing orifice of small section.

Naturally, the present invention is not limited in any way to the shown threaded configuration of the cylindrical outlet portion, which portion can be provided with any suitable means for receiving any type of dispensing endpiece and/or any type of closure cap, in particular by screw engagement or by snap-fastening.

The unit comprising the tubular body and the outlet portion is made by blow-molding, and more particularly, according to an advantageous characteristic of the invention, by extrusion/blow-molding, by placing a tubular parison having a closed end and made of a plastics material, preferably constituted by at least one polyolefin, into a mold of appropriate shape, and blowing therein. The parison may be obtained by extrusion or by coextrusion if the tubular body is made of multilayer laminated material. To enlarge or flatten the parison at its end corresponding to the bottom of the tube, two spreaders are used that take hold of the extruded parison at two diametrically opposite locations, and that are then moved apart so as to stretch the bottom end of the parison over a width that corresponds substantially to the width of the bottom end of the tube. The bottom of the parison is then closed by closing the mold, prior to blowing.

In a variant, the tube may be made by an injection-blowing technique.

Advantageously, the plastics material used when the tube is made out of a single layer is a mixture of free-radical low density polyethylene, linear low density polyethylene, and optionally high density polyethylene.

Preferably, a mixture is used comprising 50% free-radical low density polyethylene and 50% linear low density polyethylene, or in a variant, a mixture comprising 40% linear low density polyethylene, 40% free-radical low density polyethylene, and 20% high density polyethylene.

Figure 3:
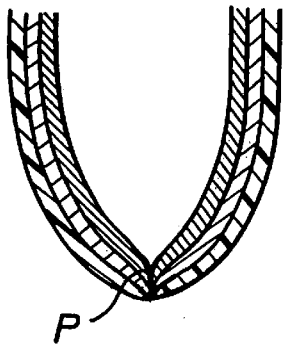
FIG. 3 is a section view on III—III of FIG. 1.

In FIG. 3, there can be seen the bottom end of the tubular body wall made up of three layers, however the invention is not limited in any way to this particular number of layers. Reference P designates the join plane obtained on closing the mold when the tubular body is made by extrusion/blow-molding.

To clarify the drawing, all three layers are shown as being of substantially the same thickness, but it should be understood that in practice the thickness of the tubular body wall is essentially determined by the thickness of the inner layer since a thick inner layer serves to ensure that the parison has good mechanical strength. The thickness of the inner layer advantageously lies in the range 0.4 mm to 0.8 mm.

The outer layer may be of made of low density polyethylene having a thickness of about 0.2 mm to 0.4 mm, for example, and the intermediate layers may each have a thickness of about 10 $\mu$m to 70 $\mu$m.

The inner layer may, for example, be constituted by low density polyethylene to constitute a barrier against water, and the intermediate layer may, for example, be constituted by a polyamide or EVOH (ethylene—vinyl alcohol copolymer) which constitutes a barrier to gases, in particular to oxygen, serving to prevent in particular the escape of any volatile odors that may be contained in the packaged substance.

Figure 1:
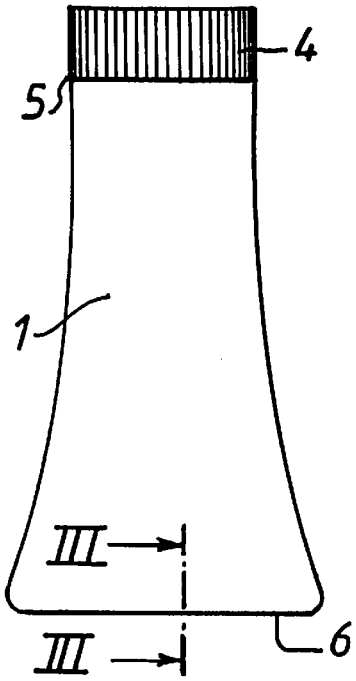
FIGS. 1 and 2 are a front elevation view and a side elevation view of a packaging tube comprising a first embodiment of the invention.
Figure 2:
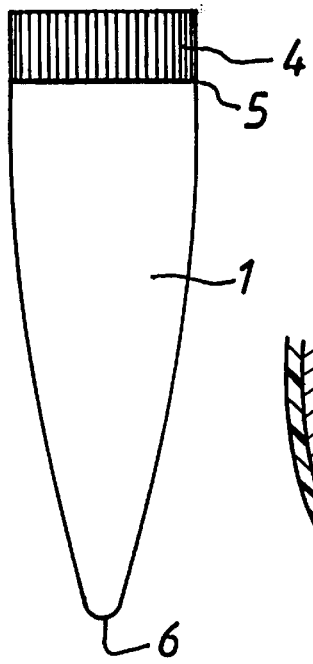

Naturally, the drawing shows the special outline of the tubular body which, seen in front elevation in FIG. 1, has apparent width that increases going from the edge, referenced 5, of the shoulder zone 2 to the base 6 of the tubular body.

As can be seen in FIG. 1, the tubular body 1 is substantially trapezium-shaped, going up from its base 6 with flanks of curved-outline.

Figure 5:
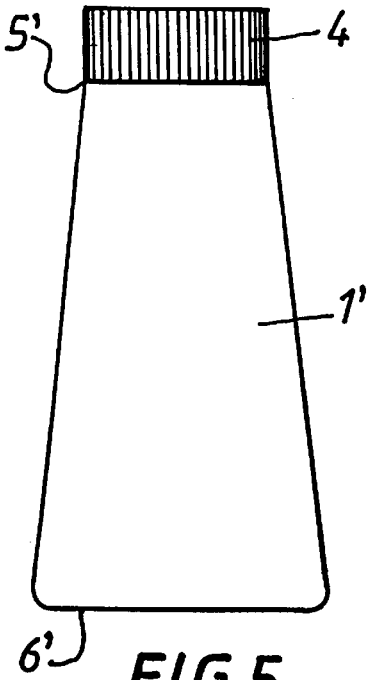
FIGS. 5 and 6 are views analogous to FIGS. 1 and 2 showing a packaging tube comprising a second embodiment of the invention.
Figure 6:
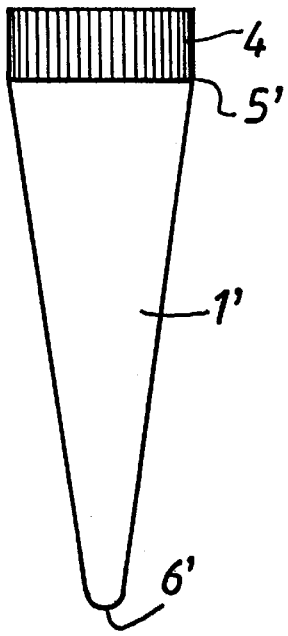

In contrast, in the embodiment shown in FIGS. 5 and 6, the tubular body 1' when seen in front elevation (FIG. 5) is substantially trapezium-shaped, but with flanks that are straight.

In both embodiments shown, the top portion 5 of the tubular body is circular in section.

Other sections may be provided within the ambit of the invention, in particular sections that are oval or elliptical.

As can be seen in the drawings, in side elevation (FIGS. 2 and 6) the tubular body 1 or 1' is of substantially V-shaped section between its base 6 or 6' and its top portion 5 or 5', with flanks that are rounded or straight as the case may be, the bottom portion 6, 6' corresponding to the vertex of the V-shape being rounded, thereby enabling the tubular body to be filled with the substance that is to be packaged over the entire height of the bottom portion of the body, unlike a body having its base constituted by a rigid zone, in particular a welded zone.

Figure 7:
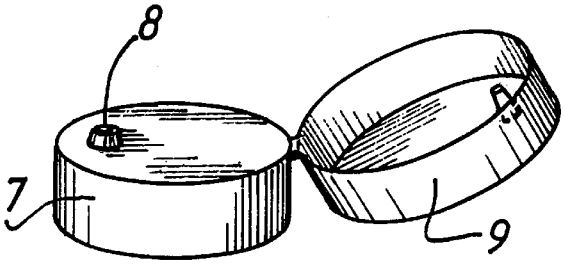
FIG. 7 is a fragmentary perspective view of a dispensing endpiece for connection to a tube of the invention.
Figure 8:
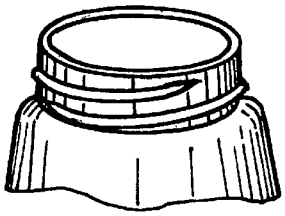
FIG. 8 is a diagrammatic view of the outlet opening of a tube to which the dispensing endpiece shown in FIG. 7 is connected.

As shown in FIGS. 7 and 8, the cylindrical outlet portion may be of large diameter and it may be provided with a dispensing endpiece 7 having a closure flap 9, with the endpiece having a dispensing orifice 8 of small section, which is advantageously located eccentrically so that the outlet for the substance is situated at the edge of the endpiece in order to limit dirtying. In the example shown in the figures, the wall of the tube where it defines the outlet opening has an outside thread and the endpiece 7 has an inside thread suitable for screw engagement on the tube.

It is also possible to fix the dispensing endpiece by snap-fastening over a ridge formed on the outlet portion of the tube, said endpiece having a small-diameter central orifice making it easier for the user to control the rate at which the substance is expelled when the tube is squeezed. The tube may be closed by screwing a cap onto the outlet portion.

Figure 9:
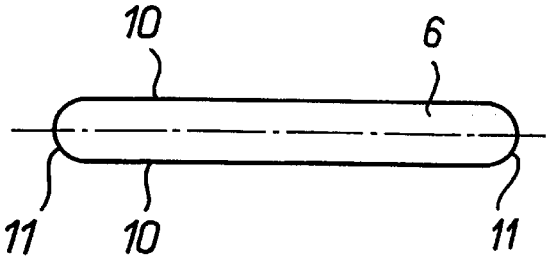
FIG. 9 is a view from beneath of the bottoms of tubes corresponding to the embodiments of FIGS. 1 to 8.

In the embodiments described above, the cross-section of the bottom end of the tube is oblong in shape, being defined by two parallel long sides 10 interconnected at their ends by two circular arcs 11, as shown in FIG. 9.

As a result, each main face of the tube is flat or even concave in shape in the bottom portion of the tube in the vicinity of the corners, and that can hinder the application of decoration to the outside surface of the tube near its bottom end.

Figure 10:
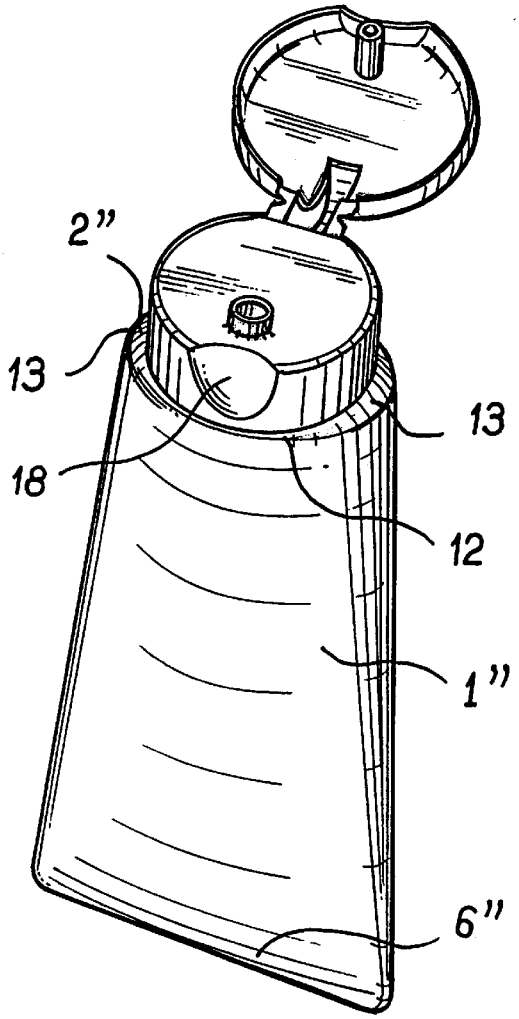
FIG. 10 is a diagrammatic perspective view of a tube comprising a third embodiment of the invention.

FIG. 10 is a perspective view of a tube 1" comprising a third embodiment of the invention and designed to make it easier to apply decoration to the main faces of the tube.

The tube 1" has a substantially plane top shoulder zone 2" whose outline 12 is oval and truncated at two diametrically opposite ends 13 adjacent to the side faces of the tube.

The midplane of symmetry of the tube is parallel to the direction of the long dimension of the tube in its top shoulder zone and corresponds to the join plane of the mold used for making the tube.

The top end of the tube 1" is provided with a cylindrical outlet portion having an outside thread, as shown in FIG. 8, with a closure capsule as shown in FIG. 7 being connected thereto by screw engagement, which capsule includes an indentation 18 to receive the finger of a user for raising the closure flap.

The threads of the closure capsule and the tube are shaped so that once the capsule has been screwed home, it is in a predetermined position relative to the tube. More precisely, in the example described, the indentation 18 comes to be situated adjacent to one of the main faces of the tube, as shown in FIG. 10.

Figure 12:
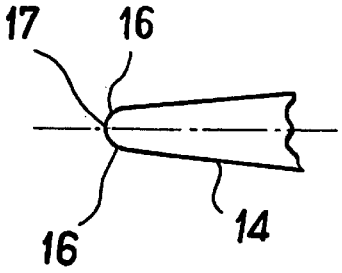
FIG. 12 is a view on a larger scale showing a detail of FIG. 11.
Figure 11:
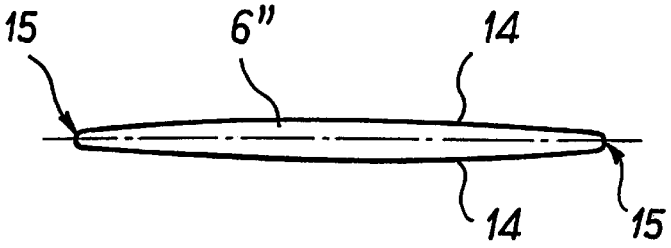
FIG. 11 is a view from beneath of the bottom end of the tube shown in FIG. 10.

Unlike the previously-described embodiments, the bottom end 6" of the tube 1" is oval in shape when seen from below, as shown in FIG. 11, being defined by two outwardly-convex long sides 14 that are united at their ends by rounded portions 15 as shown in FIG. 12, each of which is constituted by a combination of two rounded portions 16 having the same radius of curvature and a central rounded portion 17 having a larger radius of curvature than the rounded portions 16, but smaller than the radius of curvature of the sides 14.

In spite of the long sides 14 being convex, the thickness of the bottom end of the tube remains small.

As an indication, in the example described, the relative variation in the thickness of the bottom of the tube, measured at one-eighth of the width of the tube from its side ends, and measured halfway along its width, is less than 25%, and the maximum thickness of the bottom end of the tube is less than 8 mm.

The fact that the main faces of the tube are convex over their entire height makes it possible to reduce the risk of folds or bubbles being formed when a label is applied, and it increases the area that can be decorated in a single pass using conventional printing methods.

I claim:

1. A flexible packaging tube comprising a malleable elongate tubular body obtained by blow-molding, having a closed bottom without folding or crimping due to heat-sealing, a bottom end of the tubular body being contained in a plane and being oval in shape when seen from below, and a cylindrical outlet portion formed by a shoulder zone at the top of said tubular body, wherein, when the tubular body is seen in front elevation, its apparent width increases downwardly from the shoulder zone where the tubular body connects with the top cylindrical outlet portion to the bottom end constituting the bottom of the tubular body.

2. A flexible packaging tube according to claim 1, wherein the elongate tubular body is obtained by one of extruding and coextruding a parison in a mold;

closing the bottom of the parison; and blowing into the parison.

3. A flexible packaging tube according to claim 1, wherein the cross-section of the top portion of the tubular body is oval in shape.

4. A flexible tube according to claim 3, wherein the width of the tubular body at its bottom end is substantially equal to half the perimeter of said cross-section.

5. A flexible packaging tube according to claim 1, wherein the tubular body is of a shape that has curved edges when seen in front elevation.

6. A flexible packaging tube according to claim 1, wherein the tubular body is of a shape that has straight edges when seen in front elevation.

7. A flexible packaging tube according to claim 1, wherein the tubular body is made by blow-molding at least one polyolefin.

8. A flexible packaging tube according to claim 1, wherein the bottom end of the tubular body extends substantially rectilinearly, perpendicularly to the longitudinal axis of the tube.

9. A flexible packaging tube according to claim 1, wherein the outside dimensions of said cylindrical outlet portion correspond substantially to the outside dimensions of said tubular body, making allowance for the thickness of the wall of a closure capsule to be connected on said cylindrical outlet portion.

10. A flexible packaging tube according to claim 9, wherein said closure capsule and the tube are shaped so as to enable the capsule to be connected to the tube by screw engagement with the capsule being positioned once screwed home in a predetermined orientation relative to the tube.

11. A flexible packaging tube according to claim 9, wherein said closure capsule is provided with an eccentric outlet orifice for the substance.

12. A flexible packaging tube according to claim 1, wherein the inside diameter of said cylindrical outlet portion is greater than or equal to 5 mm, and wherein it includes a tapering nozzle fixed on said cylindrical outlet portion in such a manner as to reduce the diameter of the outlet orifice for the substance.

13. A flexible packaging tube according to claim 1, wherein said tubular body is constituted by a multilayer laminated material comprising an outer layer and an inner layer, in particular made of low density polyethylene, and one or more thin intermediate layers, with at least one of the inside layers constituting a barrier layer against the escape of gas, in particular oxygen or volatile odors, and is constituted in particular by polyamide or by EVOH, and wherein said tubular body has a join plane at its bottom end.

14. A flexible packaging tube according to claim 1, wherein said tubular body is made of a layer comprising a mixture of free-radical low density polyethylene and of linear low density polyethylene.

15. A flexible packaging tube according to claim 14, wherein said layer further includes high density polyethylene mixed with the free-radical low density polyethylene and with the linear low density polyethylene.

16. A process of manufacturing a flexible packaging tube, comprising forming, by blow-molding, a malleable elongate tubular body having a closed bottom, a bottom end of the tubular body being contained in a plane and being oval in shape when seen from below, and a cylindrical outlet portion formed by a shoulder zone at the top of said tubular body; wherein, when seen in front elevation, said tubular body has an apparent width increasing downwardly from the shoulder zone where the tubular body connects with the top cylindrical outlet portion to the bottom end constituting the bottom of the tubular body.

17. The process according to claim 16, comprising one of extruding and coextruding a parison and subsequently blow-molding said parison to form said tubular body.

18. The process according to claim 16, comprising:

one of extruding and coextruding a parison in an open mold;

spreading the parison at its end that corresponds to a bottom of the tube;

closing a bottom of the parison by closing the mold; and blowing the parison.

19. The process according to claim 16, wherein said blow-molding comprises injection-blowing.

* * * * *